US010085503B2

(12) United States Patent
Peral

(10) Patent No.: US 10,085,503 B2
(45) Date of Patent: Oct. 2, 2018

(54) SHIRT RETAINER UNDERGARMENT

(71) Applicant: Enrique Peral, San Juan, PR (US)

(72) Inventor: Enrique Peral, San Juan, PR (US)

( * ) Notice: Subject to any disclaimer, the term of this patent is extended or adjusted under 35 U.S.C. 154(b) by 208 days.

(21) Appl. No.: 15/052,933

(22) Filed: Feb. 25, 2016

(65) Prior Publication Data

US 2017/0245568 A1 Aug. 31, 2017

(51) Int. Cl.
*A41F 17/00* (2006.01)
*A41B 9/08* (2006.01)
*A41B 9/02* (2006.01)

(52) U.S. Cl.
CPC ..... *A41F 17/00* (2013.01); *A41B 9/02* (2013.01); *A41B 9/08* (2013.01)

(58) Field of Classification Search
CPC . A41F 17/00; A41F 9/02; A41B 9/001; A41B 9/08
USPC ..... 2/400
See application file for complete search history.

(56) References Cited

U.S. PATENT DOCUMENTS 1,280,184 A 10/1918 Dow
1,530,565 A * 3/1925 Lindauer ..... A41F 17/00 2/333
2,018,666 A 10/1935 Flesh
2,164,683 A 7/1939 Kessler
2,415,333 A 2/1947 Breier
2,567,277 A * 9/1951 Farquhar ..... A41F 11/02 2/312
3,021,838 A * 2/1962 Fine ..... A61F 5/24 128/100.1
3,091,238 A * 5/1963 De Bogory, Sr. ..... A61F 5/24 128/100.1
3,174,482 A * 3/1965 Parrott ..... A41B 9/02 2/404
3,418,659 A 12/1968 Brown
3,524,449 A * 8/1970 Peters ..... A41C 1/00 128/96.1
3,761,961 A * 10/1973 Martin ..... A41B 9/08 2/78.3
4,074,364 A * 2/1978 Lucero ..... A41F 17/00 2/117
4,501,026 A * 2/1985 Seneca ..... A41F 9/002 2/308
4,597,109 A * 7/1986 Hironaga ..... A41F 17/00 2/117
4,932,079 A * 6/1990 Bridgewater ..... A41F 17/00 128/101.1
5,033,121 A 7/1991 Larsen
5,177,813 A * 1/1993 Bosack ..... A41F 3/02 2/323
5,177,814 A * 1/1993 Courtney ..... A41F 17/00 2/323
5,193,225 A * 3/1993 Karami ..... A61F 13/64 2/220
5,276,923 A * 1/1994 Cohen ..... A41F 17/00 2/117
5,857,947 A * 1/1999 Dicker ..... A63B 21/00185 2/69.5

(Continued)

*Primary Examiner* — Richale Quinn
*Assistant Examiner* — Anne Kozak
(74) *Attorney, Agent, or Firm* — Eugenio J. Torres-Oyola; Victor M. Rodriguez-Reyes; Rafael Rodriguez-Muriel

(57) ABSTRACT

An underwear brief comprising an undergarment comprising a second waistband and position holder straps that are designed to hold a shirt down in place while inside the pants.

8 Claims, 5 Drawing Sheets

(56) References Cited

U.S. PATENT DOCUMENTS

| | | | | |
|---|---|---|---|---|
| 6,076,193 | A * | 6/2000 | Hood | A41D 1/06 2/227 |
| 6,440,094 | B1 * | 8/2002 | Maas | A61F 5/3738 2/44 |
| 6,684,410 | B2 * | 2/2004 | Robinett | A41D 1/08 2/228 |
| 8,607,367 | B2 | 12/2013 | Jones | |
| 9,538,792 | B2 * | 1/2017 | Essery | A41B 9/14 |
| 9,750,292 | B1 * | 9/2017 | Goldman | A41F 17/00 |
| 2010/0095433 | A1 | 4/2010 | Turkbas | |
| 2010/0235969 | A1 * | 9/2010 | Isaacson | A41F 17/00 2/404 |
| 2012/0246805 | A1 * | 10/2012 | Jones | A41B 9/001 2/400 |
| 2015/0230531 | A1 * | 8/2015 | Merchen | A41F 17/00 2/400 |
| 2015/0342776 | A1 * | 12/2015 | Anderson | A61F 5/40 602/70 |
| 2016/0088885 | A1 * | 3/2016 | Campbell | A41D 13/04 2/51 |
| 2016/0338436 | A1 * | 11/2016 | Horrey | A41F 17/02 |
| 2017/0238622 | A1 * | 8/2017 | Christopher | A41C 1/12 |

* cited by examiner

SHIRT RETAINER UNDERGARMENT

STATEMENT REGARDING FEDERALLY SPONSORED RESEARCH AND DEVELOPMENT

N/A

RELATED APPLICATIONS

N/A

BACKGROUND OF THE DISCLOSURE

Field of the Disclosure

The present disclosure relates generally to an undergarment designed to hold a shirt down in place while inside the pants.

Discussion of the Background

Usually business attire request wearing shirts tucked in mainly supported by outer garments, such as pants and skirts, wherein the shirt appears securely tucked into the outer garment. Unfortunately due to regular movement, such as sitting and standing, users often experience the shirttails rising up their torsos. The result is a shirt that appears loose or baggy around the outer garment.

Several attempts have been made to inhibit the rising shirttail. For example, one attempt is the use of suspenders that go underneath the pants hooking on to the top of the socks and to the bottom of the dress shirt.

Others had tried the use of magnets to hold the shirt in position, a boxer brief silicone on the side part of the legs or a adhesive belt that goes over the dress shirt for tighten it like a regular belt.

Unfortunately none of the mentioned attempts have proved to be effective in keeping the shirt inside the pants. Therefore there is a need for a product that is easy to use which secures the shirttails in a taut position.

SUMMARY

The present invention relates to an undergarment designed to hold a shirt down in place while inside the pants in a way easy to wear. In accordance with the principles of the present disclosure an undergarment including a retainer band and vertical retainers is used to avoid unwanted movement of the shirt.

Accordingly, it is an object of the present invention to provide an undergarment to secure shirttails in a taut position that is both easy to use. In accordance with the principles of the present disclosure an undergarment affixed to the underwear is used to secure the shirttails in a taut position. The undergarment is attached to the underwear in strategic areas to create the proper retaining action on the shirt.

It is another object of the present invention to provide a comfortable undergarment for the user, wherein the undergarment does not provide a bulky structure.

In general, the present disclosure overcomes the disadvantages and shortcomings of prior art by disclosing an undergarment comprising a retainer band over the underwear, wherein said retainer band is attached to the underwear at a distal end providing enough force to vertically retain the retainer band in position while holding the shirt in a taut position.

The disclosure itself, both as to its configuration and its mode of operation will be best understood, and additional objects and advantages thereof will become apparent, by the following detailed description of a preferred embodiment taken in conjunction with the accompanying drawings.

The Applicant hereby asserts, that the disclosure of the present application may include more than one invention, and, in the event that there is more than one invention, that these inventions may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the disclosure of the application, which is measured by the claims, nor is it intended to be limiting as to the scope of the disclosure in any way.

BRIEF DESCRIPTION OF THE DRAWINGS

The accompanying drawings, which are incorporated herein, constitute part of the specification and illustrate the preferred embodiment of the disclosure.

DESCRIPTION OF THE PREFERRED EMBODIMENT

Figure 1:
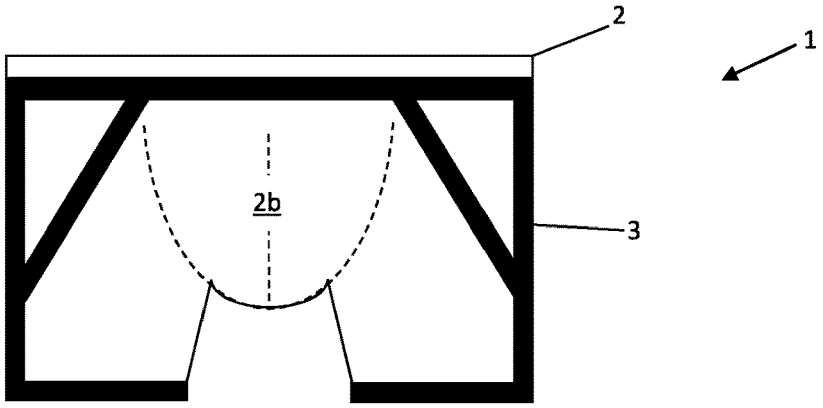
FIG. 1 shows a front view of the first exemplary embodiment in accordance with the principles of the present disclosure.
Figure 2:
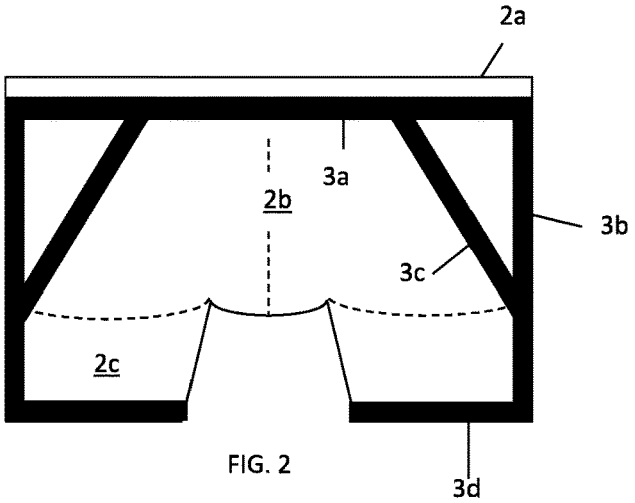
FIG. 2 shows a back view of the first exemplary embodiment in accordance with the principles of the present disclosure.
Figure 3:
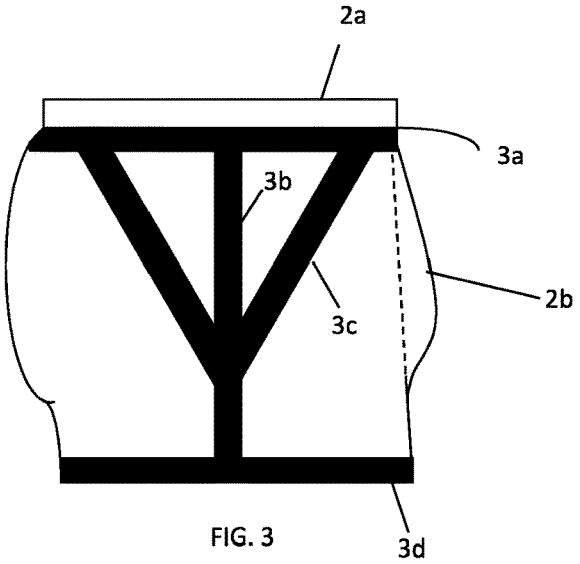
FIG. 3 shows a side view of the first exemplary embodiment in accordance with the principles of the present disclosure.

FIG. 1 through FIG. 3 show the first exemplary embodiment, more particularly a front view, back view and side view of the first exemplary embodiment 1 in accordance with the principles of the present disclosure. The first exemplary embodiment 1 comprises a first underwear 2 and an undergarment 3, wherein said undergarment 3 surrounds or encloses said first underwear 2 and wherein said undergarment 3 comprises a second waistband 3*a*, at least a vertical restrain comprising at least a pair of side support straps 3*b* and at least a pair of low-end support straps 3*d*.

FIG. 1 discloses a front view wherein the underwear 2 is surrounded by an undergarment 3. The second waistband 3*a* is located at a vertical distal end and at least a pair of low-end support straps 3*d* are located at the vertical proximal end. The vertical restrains 3*b*, 3*c* extends between the second waistband 3*a* and at least one of the low-end support straps 3*d*. Similar, FIG. 2 shows the back part of the underwear 2 wherein the undergarment 3 surrounds the underwear 2. FIG. 3 discloses the side support straps 3*c* of the undergarment 3 which extends between the second waistband 3*a* and at least one of the low-end support straps 3*d*.

The underwear 2, for example a brief, may consist of microfiber materials for the overall brief 2 or any other material such as cotton. The preferred fabric or fabrics used for the underwear is resistant to laundry cleaning processes. The brief 2 further comprises a first waistband 2*a*, a main body 2*b* and at least two leg sections 2*c*. The undergarment 3, as shown in FIG. 1 through FIG. 3, surrounds the underwear 2. The undergarment 3 is preferred to be an elastic material. The undergarment 3 comprises a second waistband 3*a* extended horizontally, at least a pair of vertical restrains 3*b*, at least a lateral support strap 3*c* and at least a pair of low-end support straps 3*d*. The second waistband 3*a* may be located on top of the first waistband 2*a*, however is preferred to be positioned lower or closer than the first waistband 2*a* with respect to the user groin area in order to avoid excessive pressure on a particular point of the waist and/or to avoid any additional increase in the persons waist size.

Figure 4:
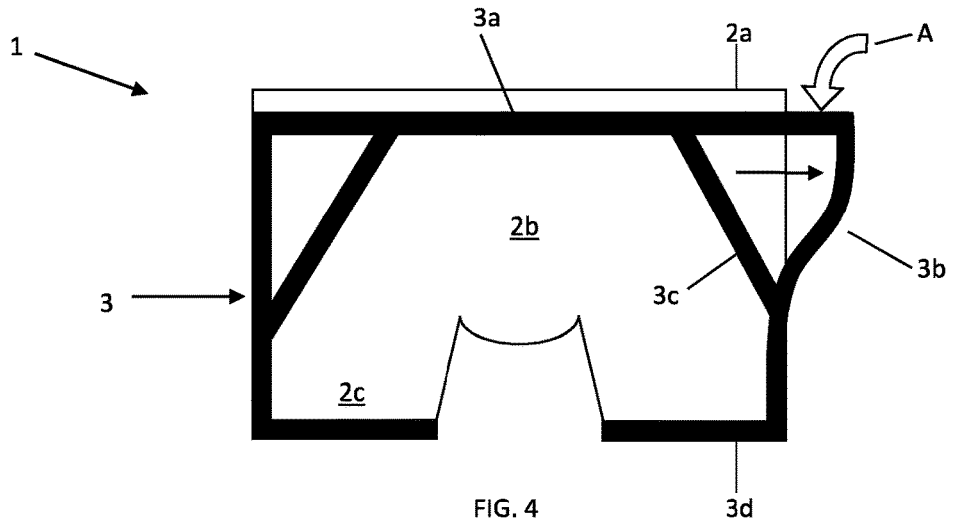
FIG. 4 shows an exemplary waistband extension for tucking the shirt into the first exemplary embodiment in accordance with the principles of the present disclosure.

FIG. 4 discloses the first exemplary embodiment 1 in accordance with the principles of the present disclosure, wherein the second waistband 3*a* expands away from the brief, more particularly away from the first waistband 2*a* to provide space A to position the lower part of a shirt between the elastic second waistband 3*a* and the first waistband 2*a*. As shown the expansion is limited also by the lateral 3*b* and diagonal support 3*c*. The combination of straps, including the low-end support 3*d* assists with the positioning of the undergarment 3 which is preferred to be close to the body while avoiding the shirt to come out when fixing a shirt between the second waistband 3*a* and the first waistband 2*a*.

Figure 5:
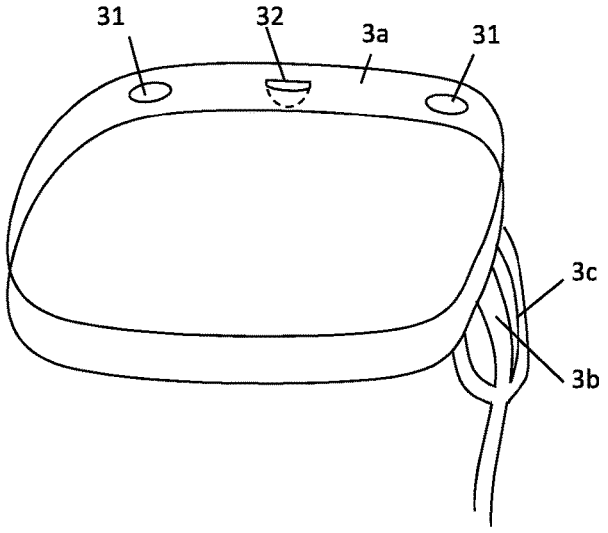
FIG. 5 shows a cut out view of the undergarment in accordance with the principles of the present disclosure.

FIG. 5 is directed to the undergarment in accordance with the principles of the present disclosure, more particularly to additional elements attached to the second waistband 3*a*. In the present disclosure the second waistband 3*a* comprises sticky elements 31 and/or pockets 32 for inserting attachment means such as magnets.

Figure 6:
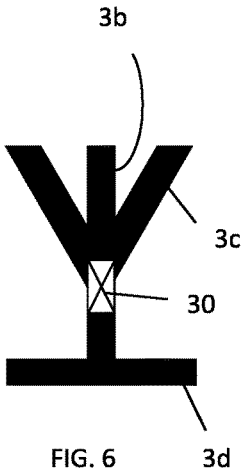
FIG. 6 shows an exploded view of the vertical exemplary restrains of the undergarment in accordance with the principles of the present disclosure.

FIG. 6 shows an exploded view of the vertical restrains 3*b*, 3*c*. Each low-end support 3*d* comprises a cylindrical shape intended to fit user's leg which is mechanical connected to the second waistband 3*a* by means of the lateral support straps 3*b* and a diagonal support 3*c*. The lateral support strap 3*b* and diagonal support 3*c* is preferred to expand vertically while the second waistband 3*a* and low-end support 3*d* is preferred to expand on the horizontal direction. The diagonal support 3*c* is preferred to expand diagonal with respect to the second waistband 3*a* and low-end support 3*d*. The lateral support strap 3*b* and diagonal support 3*c* contact the second waistband 3*a* at different points mainly separated and intersect at an intersection point 30 located at a lower part of the lateral support straps 3*b*. The purpose of the present configuration is to pull back the second waistband 3*a* to its original position once the user tucks in the shirt. This action avoids the shirt coming out when fixing a shirt between the second waistband 3*a* and the first waistband 2*a*.

Figure 7:
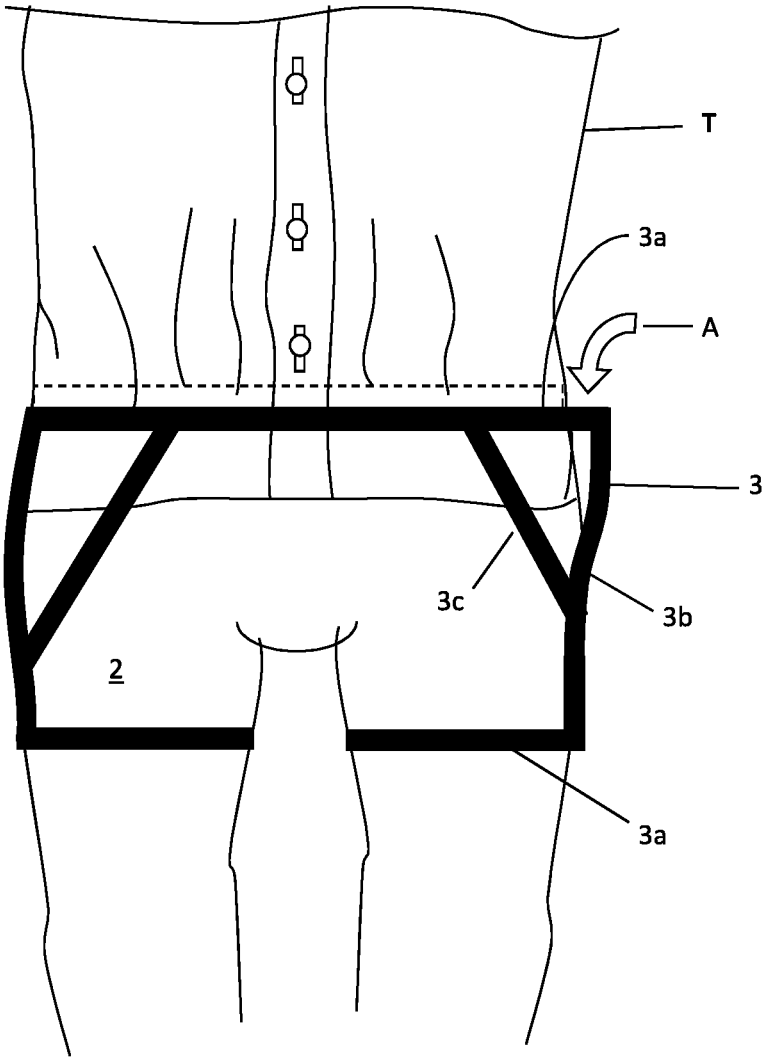
FIG. 7 shows the first exemplary embodiment of the undergarment used with men's underwear in accordance with the principles of the present disclosure.
Figure 8:
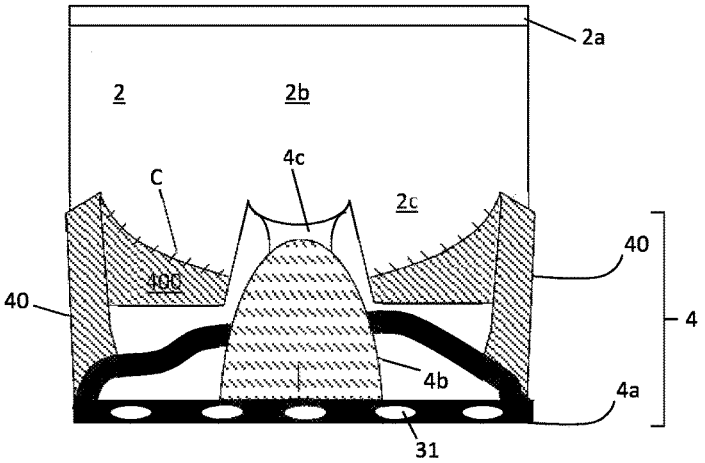
FIG. 8 shows the second exemplary embodiment in accordance with the principles of the present disclosure.
Figure 9:
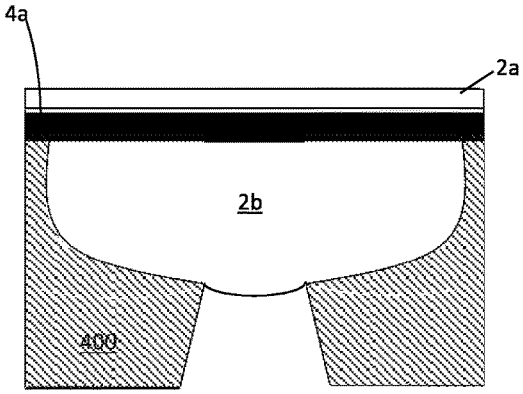
FIG. 9 shows a front view of the second exemplary embodiment in accordance with the principles of the present disclosure.
Figure 10:
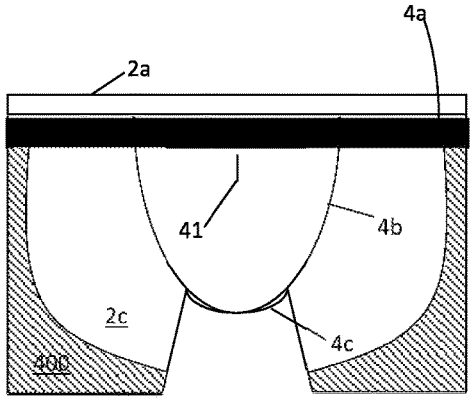
FIG. 10 shows a back view of the second exemplary embodiment in accordance with the principles of the present disclosure.
Figure 11:
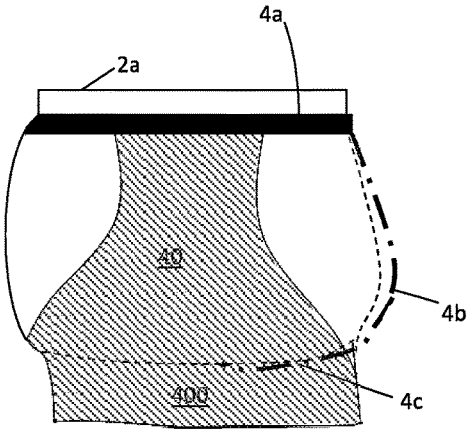
FIG. 11 shows a side view of the second exemplary embodiment in accordance with the principles of the present disclosure.

FIG. 7 discloses a user wearing the underwear 2 with the undergarment 3 while pulling away the second waistband 3*a* from the first waistband 2*a* (not shown) to provide space A to position the lower part of the shirt T between the elastic second waistband 3*a* and the first waistband 2*a*. As mentioned above, the expansion is limited also by the lateral 3*b* and diagonal support 3*c*.

FIG. 8 through FIG. 12 are directed to the second embodiment of the present disclosure. Similar to the first embodiment, the underwear 2 comprises a first waistband 2*a*, a main body 2*b* and at least two leg sections 2*c*. The second undergarment 4 surrounds the underwear 2. The second undergarment 4 comprises a second waistband 4*a* extended horizontally, at least a pair of vertical restrains 40 comprising at least a lateral support strap and at least a pair of low-end support 400. The second waistband 4*a* may be located on top of the first waistband 2*a*, however is intended to be positioned lower or closer than the first waistband 2*a* with respect to the user groin area in order to avoid excessive pressure on a particular point of the waist and/or to avoid any additional increase in the persons waist size. The vertical restrains 40 are preferred to expand vertically while the second embodiment waistband 4*a* and low-end support 400 are preferred to expand on the horizontal direction. Similar to the first embodiment the vertical restrain 40 is configured to pull back the second waistband 4*a* to its original position once the user tucks in the shirt, this action avoids the shirt coming out when fixing the shirt T between second waistband 4*a* and the first waistband 2*a*. Also the second waistband 4*a* is equipped with sticky elements 31 in order to assists holding a shirt in position.

Further a middle section 4*b* is attached to the groin area or under the genital area by a middle attachment 4*c*, wherein said middle section 4*b* extends from the middle attachment 4*c* to the second waistband 4*a*. The low-end support 400 is sewed or attached to the underwear 2 preferably to leg sections 2*c* by attaching means C. The middle section 4*b* comprises a recess 41 to provide space to pass through at least a button from the shirt T.

Figure 12:
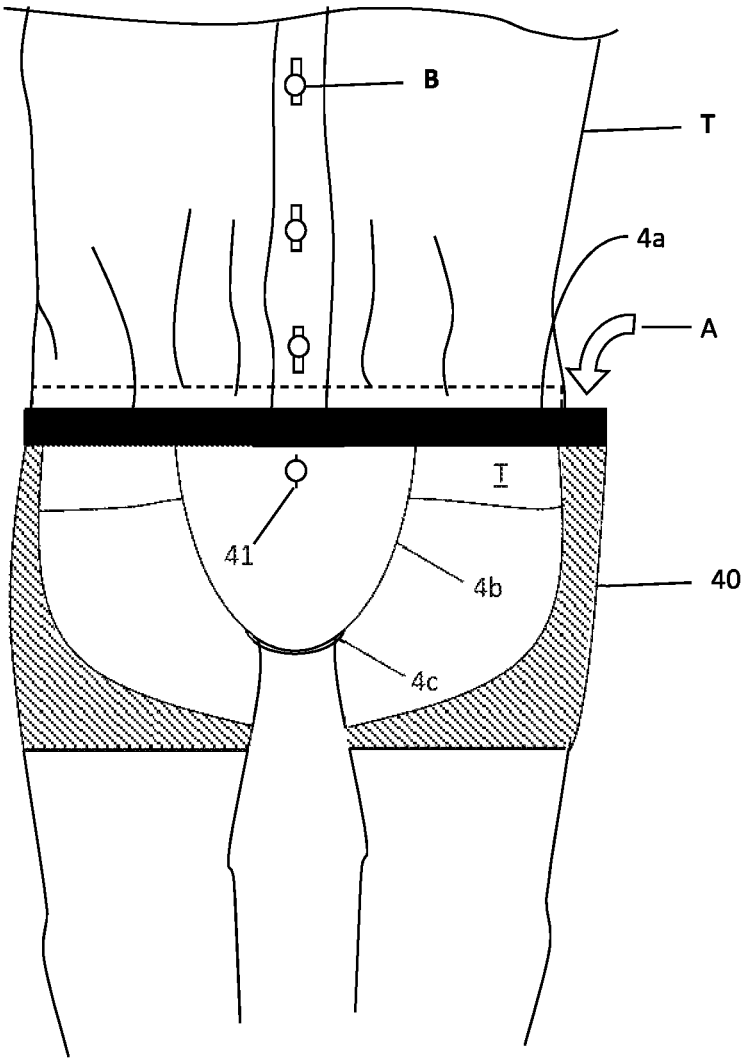
FIG. 12 shows the second exemplary embodiment of the undergarment used with men's underwear in accordance with the principles of the present disclosure.

FIG. 12 discloses a user wearing the underwear 2 with the second undergarment 4, wherein the second waistband 4*a* is pulled away from the first waistband 2*a* to provide enough space to position the lower part of the shirt T between the elastic second waistband 4*a* and the first waistband 2*a*. As mentioned above, the expansion is limited also by the vertical restrain 40. Further the unwanted displacement of the shirt T is avoided by the holding action provided by the second waistband 4*a* while a button B passing through the recess 41 also assists with the vertical displacement of the shirt T.

The disclosure is not limited to the precise configuration described above. While the disclosure has been described as having a preferred design, it is understood that many changes, modifications, variations and other uses and applications of the subject disclosure will, however, become apparent to those skilled in the art without materially departing from the novel teachings and advantages of this disclosure after considering this specification together with the accompanying drawings. Accordingly, all such changes, modifications, variations and other uses and applications which do not depart from the spirit and scope of the disclosure are deemed to be covered by this disclosure as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present disclosure, as well as equivalents thereof. The details in the patents, patent applications, and publications incorporated by reference herein may be considered to be incorporable at applicant's option, into the claims during prosecution as further limitations in the claims to patently distinguish any amended claims from any applied prior art.

The invention claimed is:

1. A system for retaining a shirt in place, comprising:

an underwear comprising a main body having a top end and a bottom end;

at least two leg sections on the bottom end of the main body;

a groin area section located in the middle of the main body and between the at least two leg sections, wherein the at least two leg sections on the bottom end of the main body extend beyond a bottom area of the groin area section;

a first waistband attached to the top end of the main body and extending horizontally along said top end of the main body;

an undergarment surrounding a portion of the main body and comprising at least two vertical restraints, each vertical restraint having a first end and a second end, wherein each first end comprises a lateral support strap that expands vertically and is attached to a second waistband that expands horizontally along the main body, and each second end comprises a low-end support area that is attached to and expands horizontally along each corresponding leg section of the at least two leg sections on the bottom end of the main body, wherein the undergarment further comprises a middle section having at least a first distal end and a second distal end, wherein said at least first distal end is attached to the second waistband and said at least second sewn attached to the bottom area of the groin area section, wherein the middle section covers the groin area section of the main body, thus forming a space between the middle section and the groin area section of the main body, wherein the middle section comprises at least one button hole for attaching the button of a dress shirt.

2. The system for retaining a shirt in place, as in claim 1, wherein the second waistband is made of elastic material.

3. The system for retaining a shirt in place as in claim 1, wherein the at least two vertical restraints comprise at least a pair of diagonal support straps.

4. The system for retaining a shirt in place as in claim 1, wherein the second waistband comprises at least one element that is capable of sticking to a dress shirt.

5. The system for retaining a shirt in place as in claim 1, comprising: wherein the second waistband comprises pockets for inserting attachment means.

6. The system for retaining a shirt in place as in claim 5, wherein the attachment means are magnets.

7. The system for retaining a shirt in place as in claim 1, wherein the second waistband can be positioned on top of the first waistband.

8. The system for retaining a shirt in place as in claim 4, wherein the at least one element that is capable of sticking to a dress shirt is a rubber element.

* * * * *